US005967876A

United States Patent [19]

Kollmanthaler et al.

[11] Patent Number: 5,967,876

[45] Date of Patent: Oct. 19, 1999

[54] BRASSIERE WITH SUPPORT UNDERWIRES

[75] Inventors: Siegfried Kollmanthaler, Ottobrunn, Germany; Christa-Heidi Kunz, Wien; Adolf Woltron, Katzelsdorf, both of Austria

[73] Assignee: Triumph International Aktiengesellschaft, Munich, Germany

[21] Appl. No.: 09/006,705

[22] Filed: Jan. 14, 1998

[30] Foreign Application Priority Data

Jan. 15, 1997 [DE] Germany ..... 297 00 566

[51] Int. Cl.[6] ..... A41C 1/14

[52] U.S. Cl. ..... 450/41; 450/46; 450/47

[58] Field of Search ..... 450/41, 42, 43, 450/44, 45, 46, 47, 48, 49, 50, 51, 52, 53; 2/255, 256, 257, 258, 259, 260, 260.1, 261, 262, 263, 264

[56] References Cited

U.S. PATENT DOCUMENTS 2,829,650 4/1958 Guide ..... 450/46

5,387,150 2/1995 Terrell .

FOREIGN PATENT DOCUMENTS 0752213 1/1997 European Pat. Off. .

1085245 1/1955 France ..... 450/45

1256118 2/1961 France ..... 450/48

*Primary Examiner*—Gloria Hale

*Attorney, Agent, or Firm*—Friedrich Kueffner

[57] ABSTRACT

A brassiere (1) with two bust cups (6) and two side parts (2) connected to the latter has along the lower edges (5) of the cups (6) a respective pocket for replaceably accommodating a U-shaped support underwire. These pockets have at their ends situated in the front middle zone (3) of the brassiere (1) openings for the insertion or removal of the underwires. A retaining element (11) is provided between the cups (6) in the vicinity of these openings in the front middle zone (3) of the brassiere (1), with which retaining element (11) the ends of the underwires associated therewith and projecting from the pockets can be brought into a releasable operative connection.

9 Claims, 3 Drawing Sheets

BRASSIERE WITH SUPPORT UNDERWIRES

TECHNICAL FIELD

The invention relates to a brassiere with two bust cups and two side parts connected to the latter, in which a respective pocket for accommodating a U-shaped support underwire is provided along the lower edges of the cups, which pocket has in the vicinity of each end of the underwires an opening for the insertion or removal of the respective underwire.

STATE OF THE ART

In known brassieres of this type the shape-retaining underwires consist of relatively stiff resilient material, for example metal or plastics, which are inserted into a respective elongate pocket formed from textile material, extending along the bust attachment seam and closed at the ends.

Since the underwires can move longitudinally in these pockets, not only when being worn but, in particular, when brassieres of this type are washed in a washing machine the danger arises that the ends of the underwires will at the ends of the pockets penetrate through the fabric of the material forming the pockets. During the washing process the underwires can even be completely ejected from the pockets. If an underwire of this type has become completely detached from the article being washed, the danger then arises that it will pass through the holes in the washing drum and could prevent further rotation of the washing drum. In the past many washing machines were damaged in this way by the support underwires of brassieres.

For this reason, many washing machine producers recommend that brassieres of this type should only be washed by hand. However, hand washing is laborious and is unsatisfactory if the fabric of the brassiere contains cotton, the soiling of which can hardly be removed by hand washing at low temperatures.

To enable also brassieres of this type to be washed in a washing machine, it is known to design the pockets for accommodating the underwires in such a way that the underwires can be removed for washing and then reinserted. For this purpose, at each end of the pockets an opening is provided, for example a slot extending transversely to the direction in which the pocket extends, or the end of the pocket is covered by a strip extending transversely thereto so as to prevent the underwires from protruding unintentionally (EP 0 752 213 A1). These openings are principally provided at the outer ends of the pockets. However, it cannot be assured, in particular after being worn for a long time and after being washed a number of times, that the ends of the underwires will not protrude from the openings, in which case they could irritate or hurt the wearer's skin.

In contrast thereto, to prevent longitudinal movement of the support underwires in the pockets it is already known to connect the ends of the support underwires securely to the respective brassiere (U.S. Pat. No. 5,387,150). To ensure that the wearer's mobility is not impaired, on the one hand, fasteners are provided at the underwire ends, which are articulated in one direction and, on the other hand, further articulations are disposed along the underwires. Apart from the fact this necessitates a very complicated design of the underwire and the fastening means, the danger is still present both when being worn but particularly when being washed that the fastening means can become detached from the material of the brassiere and can damage the underwires of the brassiere or other articles of washing, or possibly even the washing machine.

ILLUSTRATION OF THE INVENTION

Taking the foregoing into consideration, the invention is based on the object of providing a possibility in brassieres with removable support underwires of preventing longitudinal movement of the underwires or preventing the underwires from protruding from the openings which are necessary for their insertion or removal.

In a brassiere of the type indicated in the introduction this object is achieved in that means are provided in the vicinity of the opening of the pockets for securing the respective underwires in the inserted position, wherein these means comprise at least one retaining element attached between the cups in the front middle zone of the brassiere, with which retaining element a respective end of an underwire associated therewith can be brought into a releasable operative connection.

The basic idea of the invention thus lies in releasably securing the underwires in the inserted condition by mechanical means. These means are advantageously disposed at the location at which the openings for the pockets of both cups are situated closest together, namely in the front middle zone of the brassiere between the cups. Mechanical retaining elements for the underwires interfere least of all at this location, especially as here they can take the form, for example, of a clasp or other ornamental item which in any case are often provided at this location for decorative purposes.

According to the invention each underwire can be associated with a separate retaining element or the retaining elements of both underwires can be combined to form a uniform retaining means.

The releasable operative connection can be in the form of a press-stud, a projection on one part being associated with a recess on the other part to receive this projection. A prerequirement for this is that, for example, a stud at the end of an underwire can be fitted in a recess in a retaining element or a perforation at the end of an underwire ca n be fitted on a stud on the retaining element. A connection of this type is easily effected and undone; moreover, it allows certain rotating movements in the plane of the brassiere following the surface of the body, because it acts like a joint.

If the retaining elements of both underwires are combined to form a uniform retaining means, it is advantageous for the retaining elements to be disposed on a common base plate which can also be covered by a cover plate connected in a pivotably hinged manner with the base plate.

The retaining element or retaining means and/or the underwires advantageously consist of plastics material which, as is well known, can be readily moulded in any shape desired. The retaining elements or retaining means and/or the ends of the underwires associated therewith can also be attractively and aesthetically designed and/or ornamentally decorated.

BRIEF DESCRIPTION OF THE DRAWINGS

The invention will be illustrated in more detail below with reference to the drawings, wherein.

WAYS OF CARRYING OUT THE INVENTION AND INDUSTRIAL APPLICATION

Figure 1:
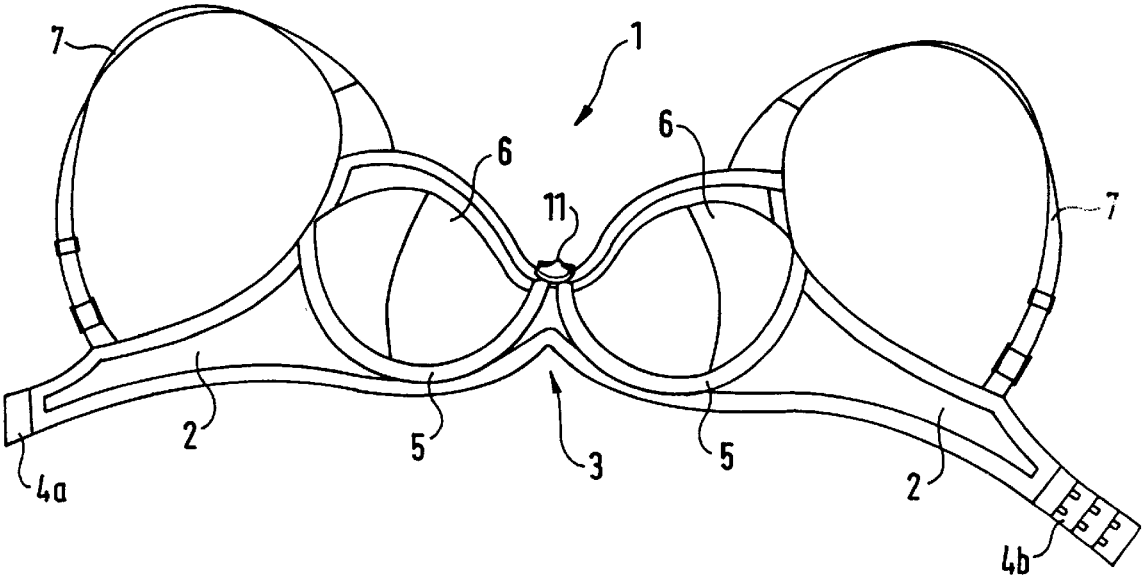
FIG. 1 shows a view of a brassiere designed in accordance with the invention with a retaining means for both support underwires arranged in the front middle zone.

As is evident from FIG. 1, the brassiere 1 according to the invention comprises two side parts 2 which are joined together at a front middle zone 3 of the brassiere and at the outer ends are provided with parts 4*a,* 4*b* for a back fastening. The bust cups 6 are sewn in along a bust attachment seam 5 and they can, in principle, be shaped in manner desired. Support straps 7 are attached to the upper edges of the cups 6 and they extend in conventional manner to the rear regions of the side parts 2.

The individual parts of the brassiere 1 consist of a textile material, all of which or parts of which may also be designed to be stretchable; this does not have any influence on the invention. The application of the invention is not restricted to the described embodiment of a brassiere; in principle, it can used in all articles of women's underwear with an attached or elaborated bust part with support underwires, including swimsuits.

Figure 2:
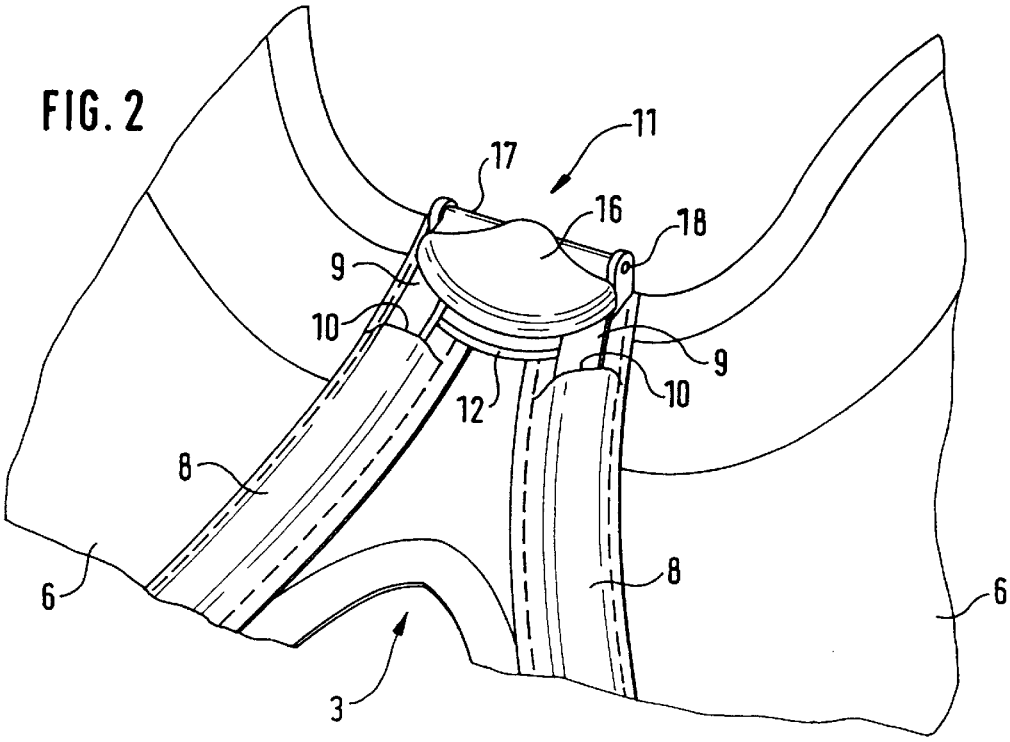
FIG. 2 shows an enlarged illustration of the front middle zone with the retaining means in the closed condition.

As is evident from FIG. 2, which shows an enlarged illustration of the upper part of the front middle zone 3 of the brassiere, pockets 8, into which respective support underwires 9 are inserted, extend along the bust attachment seams 5 of the cups 6. The pockets 8 can be applied from the outside or from the inside, or they can also be formed or made from the material of the side parts 2; it is essential that each of the pockets 8 has at the ends situated in the front middle zone 3 of the brassiere openings 10 through which the underwires can be introduced into the pockets 8 or else removed therefrom. In conventional manner, the underwires 9 consist of a stiff resilient material, for example metal or plastics.

In the embodiment illustrated by way of example, the upper inner ends of the underwires 9, which protrude from the pockets 8, are situated closely side by side and at this location are combined to form a retaining means 11. The design and function of this retaining means 11 can be see more clearly with reference to FIGS. 3 and 4 which, unlike FIG. 2, show the retaining means 11 in a pivoted-up position.

Figure 3:
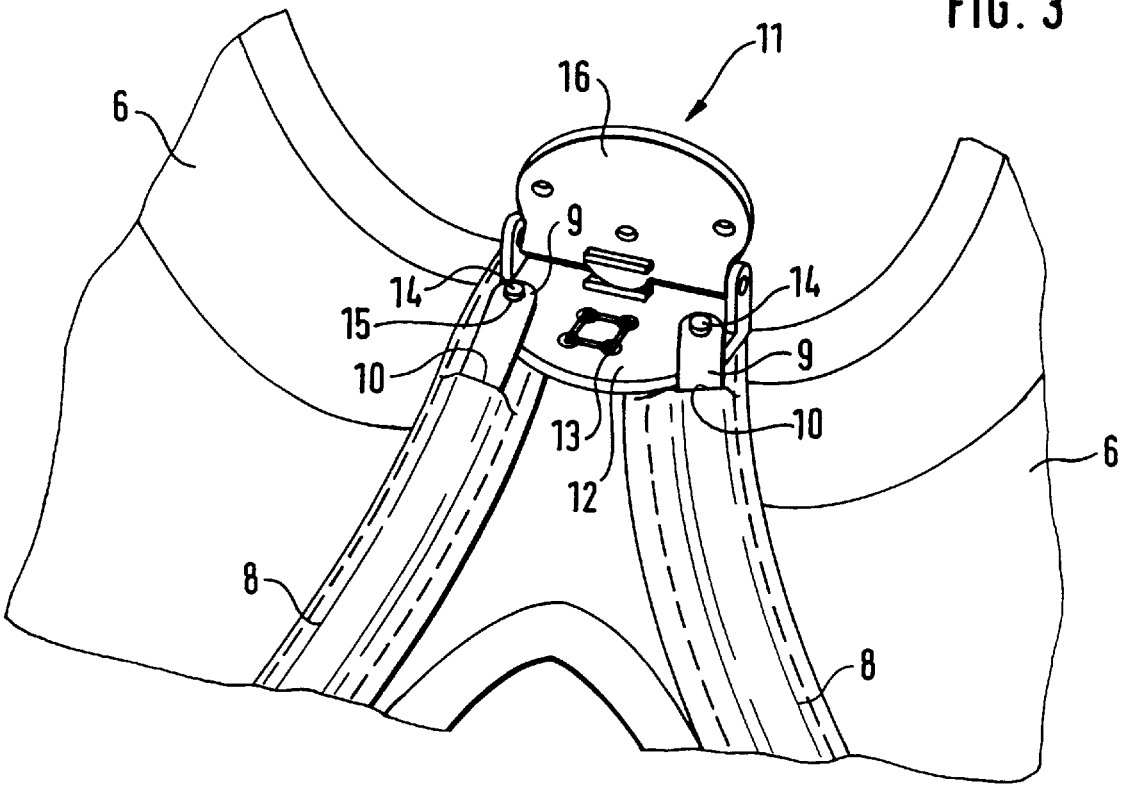
FIG. 3 shows an illustration corresponding to FIG. 2, with the cover plate open.
Figure 4:
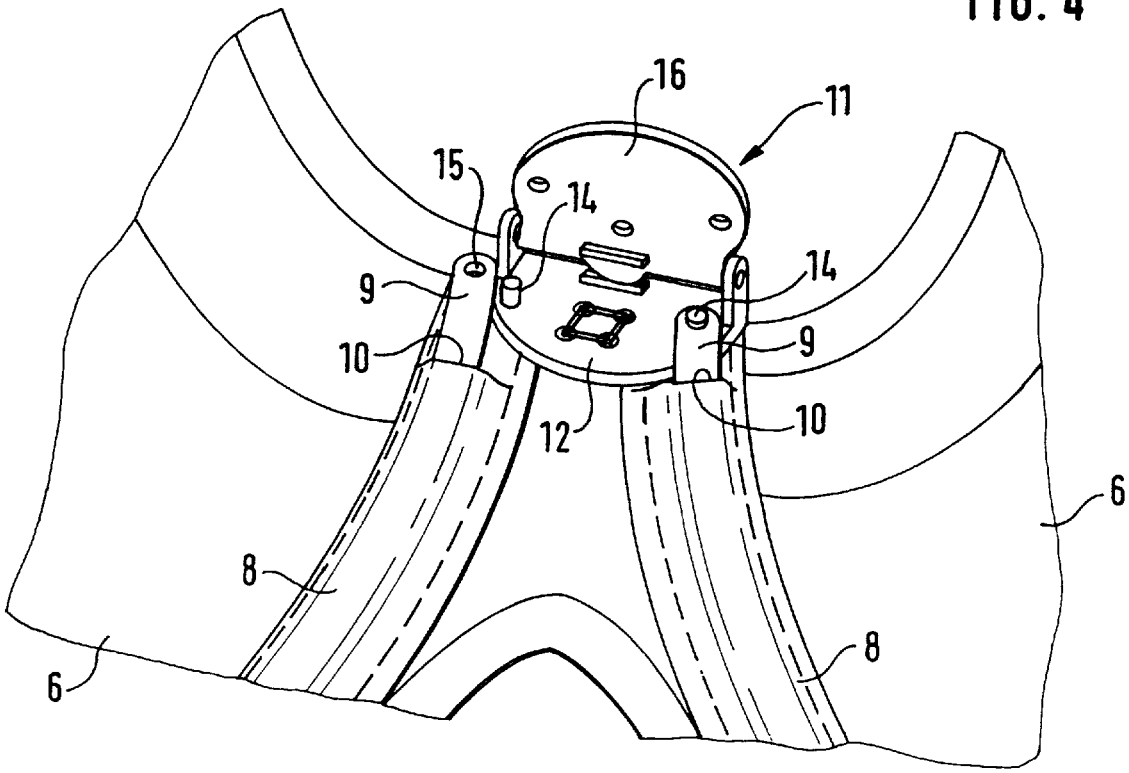
FIG. 4 shows an illustration corresponding to FIG. 3, in which an underwire is released from the fastening.

As FIG. 3 shows, the retaining means 11 comprises a base plate 12 with holes 13 by means of which it can be sewn like a button to the textile material of the brassiere 1. Two studs 14 protrude from the base plate 12, on to which the underwires 9 can be fitted by means of perforations 15 which are provided at their ends (FIG. 4). The underwires 9 can thereby be secured in the pockets 8 against longitudinal movement, above all they can be prevented from projecting therefrom.

The retaining means 11 is completed by a cover plate 16 which along the upper straight edge 17 of the base plate 12 is connected thereto by hinges 18 (FIG. 2). A catch is provided so as to retain the cover plate 16 in the pivoted-down position covering the studs 14 at the underwire ends.

To remove the underwires from the pockets 8 for washing firstly, as is evident from FIG. 4, the cover plate 16 of the retaining means 11 is pivoted up, thereby exposing the ends of the underwires 9. The underwires 9 are removed from the studs 14, whereupon the underwires 9 can be withdrawn from the pockets 8 and the brassiere 1 can be washed. After washing or after drying, the underwires 9 are reinserted into the pockets 8, the ends of the underwires 9 are refitted with the perforations 15 on the studs 14 and the cover plate 16 is pivoted down.

Figure 5:
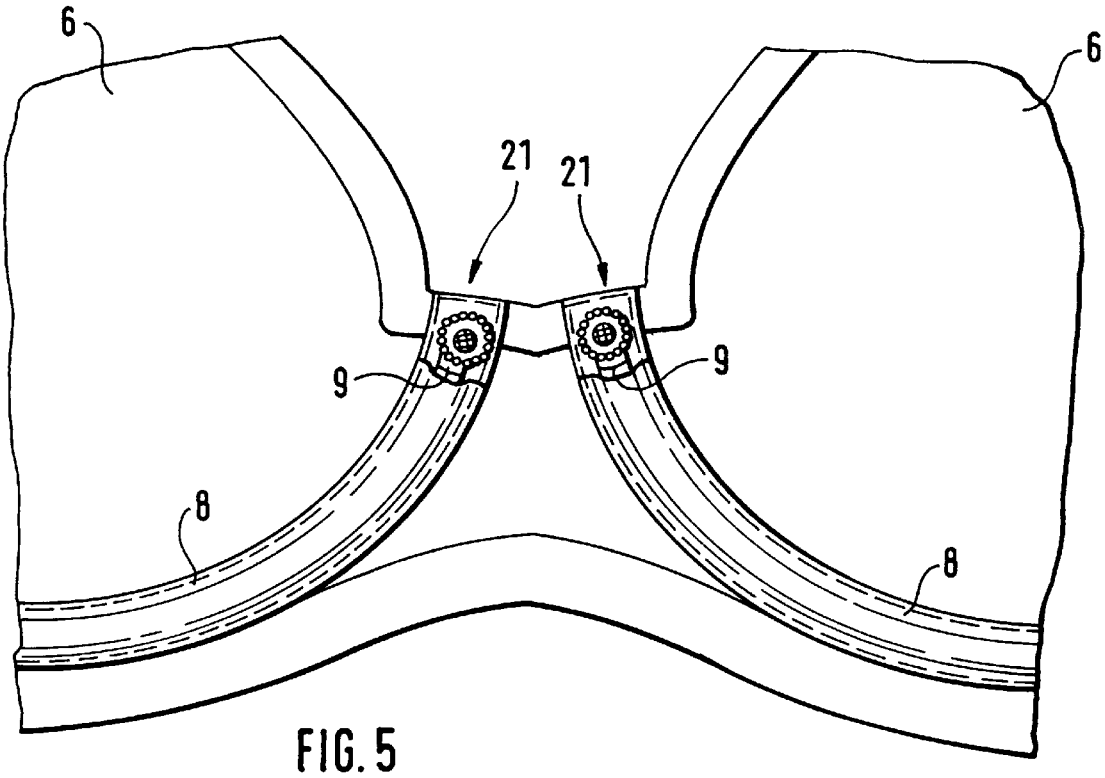
FIG. 5 shows an enlarged illustration of the front middle zone of a brassiere, in which each underwire is associated with a retaining element.
Figure 6:
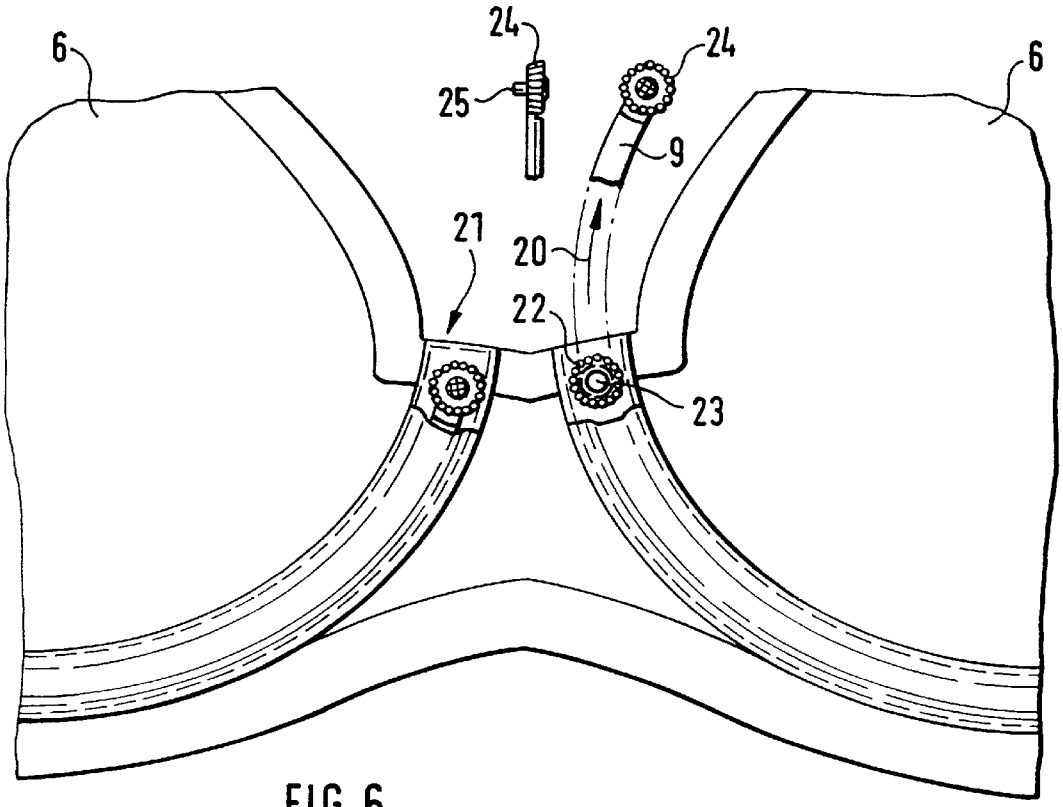
FIG. 6 shows an illustration according to FIG. 5, with an underwire partly removed.

FIGS. 5 and 6 illustrate another example of embodiment of a brassiere according to the invention, in which each underwire 9 is associated with its own separate retaining element 21. FIG. 5 shows the brassiere with underwires 9 inserted into the pockets 8 and FIG. 6 shows the situation in which the right-hand underwire in the illustration is removed from its pocket in the direction of arrow 20.

In this example the retaining elements 21 each comprise a small base plate 22 of rosette-like design having a central recess 23. A rosette 24 corresponding in shape and size to the base plate 22 is formed on the end of the underwire 9 and has a stud 25 on the underside facing the base plate 22. After the insertion of the underwire 9 into the pocket 8 it can be simply secured by pressing the stud 25 into the recess 23 in the base plate 22. The release of the operative connection takes place in the reverse manner.

We claim:

1. A brassiere with two bust cups and two side parts connected to the bust cups, each bust cup having along a lower edge thereof a pocket for receiving a U-shaped support underwire, each pocket having adjacent an end of the underwire an opening for inserting and removing the underwire, further comprising securing means for releasably securing the underwire in an inserted position thereof, the securing means comprising at least one retaining member attached to the brassiere adjacent the opening, the at least one retaining element comprising a press-stud connection between the at least one retaining element and the end of the underwire, wherein one of the end of the underwire and the at least one retaining element has a projection and another of the end of the underwire and the at least one retaining element has a recess for receiving the projection.

2. The brassiere according to claim 1, wherein the at least one retaining element is disposed between the cups in a front middle zone of the brassiere.

3. The brassiere according to claim 1, comprising a separate retaining element for each underwire.

4. The brassiere according to claim 1, wherein two retaining elements for the underwires of the two bust cups are combined so as to form a uniform retaining means.

5. The brassiere according to claim 4, wherein the retaining elements are mounted on a common base plate.

6. The brassiere according to claim 5, further comprising a cover plate for covering the base plate.

7. The brassiere according to claim 6, further comprising a hinge connection between the cover plate and the base plate.

8. The brassiere according to claim 1, wherein the at least one retaining element and the underwires are of plastics material.

9. The brassiere according to claim 1, wherein the at least one retaining element and the end of the underwire are provided with at least one of an attractive and aesthetic design and an ornamental decoration.

* * * * *